United States Patent [19]

Hansen et al.

[11] 4,227,231

[45] Oct. 7, 1980

[54] INTEGRAL RELAY LOW VOLTAGE RETENTIVE MEANS

[75] Inventors: James E. Hansen, Oak Creek; Willard S. Lorenz, Oconomowoc, both of Wis.

[73] Assignee: Eaton Corporation, Columbus, Ohio

[21] Appl. No.: 939,858

[22] Filed: Sep. 5, 1978

[51] Int. Cl.[2] ..... H01H 47/04

[52] U.S. Cl. ..... 361/154; 361/194

[58] Field of Search ..... 361/154, 194, 152, 160, 361/187

[56] References Cited

U.S. PATENT DOCUMENTS

| | | | |
|---|---|---|---|
| 2,951,133 | 8/1960 | Davies et al. | 335/154 |
| 3,108,208 | 10/1963 | Hayter . | |
| 3,456,164 | 7/1969 | Sternberg | 361/194 X |
| 3,551,754 | 12/1970 | Shaffer . | |
| 3,689,808 | 9/1972 | Stampfli . | |
| 3,737,736 | 6/1973 | Stampfli . | |
| 3,769,550 | 10/1973 | Lee . | |
| 3,786,314 | 1/1974 | Misch . | |
| 3,824,434 | 7/1974 | Boley et al. | 361/142 |
| 4,114,184 | 9/1978 | Stampfli | 361/154 |

*Primary Examiner*—Harry E. Moose, Jr.

*Attorney, Agent, or Firm*—Hugh R. Rather; Wm. A. Autio

[57] ABSTRACT

An electromagnetic relay is provided with a high current "boost" coil, a lower current normal operating or "seal" coil and a static, electronic circuit that functions under low voltage conditions to energize the boost coil to retain the relay closed. An additional function of this static, electronic circuit is to energize the boost coil for a time interval on initial power application in order to assist in closing the relay, and this time interval automatically varies in the correct direction with variation in the supply voltage available to the coil so that the lower such available voltage is from its normal value, the longer the boosting time interval. At other times, both coils are energized in series at low current to hold the relay closed. This static, electronic circuit is small enough to be integrally incorporated within the housing of a conventional sealed power relay.

12 Claims, 5 Drawing Figures

INTEGRAL RELAY LOW VOLTAGE RETENTIVE MEANS

BACKGROUND OF THE INVENTION

When a power relay is used in an application where the normal operating coil voltage is in the range of 24 to 32 volts D.C., but where this voltage frequently drops to as low as 6 to 8 volts D.C, the consequent result would be intermittent opening and chattering of the relay contacts. A simple solution might be to use a relay with a lower voltage coil, but then the excessive heat dissipation created at normal voltage levels would be prohibitive. It has therefore become desirable to combine an electronic circuit with the relay coil system to assure adequate coil power at low voltages but yet limit power at normal voltage levels and to provide such electronic system small enough to enable it to be mounted within the housing of a conventional power relay.

Circuits for controlling power and maintenance coils of an electromagnetic relay have been known heretofore.

One way to do this has been to use dynamic contact switching. For example, C. E. Hayter U.S. Pat. No. 3,108,208, dated Oct. 22, 1963, shows a circuit where, upon application of power, a control relay closes a contact to shunt the auxiliary winding, causing the main winding to be energized across the line. Upon closure, the electromagnetic relay also opens a contact in the control relay circuit to reopen its contact and reinsert the auxiliary winding in series with the main winding for maintaining the relay.

Another known way to do this has been to use a static electronic circuit to control energization of the power and maintenance windings. For example, H. Stamplfi U.S. Pat. No. 3,737,736, dated June 5, 1973, shows a circuit having a full-wave rectified A.C. power source supplying a controllable thyristor that controls energization of the power winding of an electromagnet, the maintenance winding being connected in parallel therewith across the full-wave rectifier bridge, this circuit being limited to use with A.C. since an SCR cannot be turned off in a circuit supplied with D.C.

This invention relates to improvements thereover.

SUMMARY OF THE INVENTION

An object of the invention is to provide improved relay control means.

A more specific object of the invention is to provide improved integral means for operating an electromagnetic relay.

Another specific object of the invention is to provide improved means for maintaining operation of a relay under low voltage conditions.

Another specific object of the invention is to provide improved means for variably boosting relay closure under variable supply voltage conditions so as to adjust boosting time as an inverse function of the supply voltage variation from normal value.

Another specific object of the invention is to provide improved static electronic means that not only function upon initial energization of a D.C. relay to energize its boosting coil for a timed interval but also lengthens such time interval under reduced voltage conditions, and in addition reenergizes such boosting coil in the event the supply voltage falls to or below a predetermined value.

Another specific object of the invention is to provide improved means of the aforementioned type that is small enough to be mounted within the conventional housing of a standard relay.

Other objects and advantages of the invention will hereinafter appear.

DESCRIPTION OF THE PREFERRED EMBODIMENT

Figure 1:
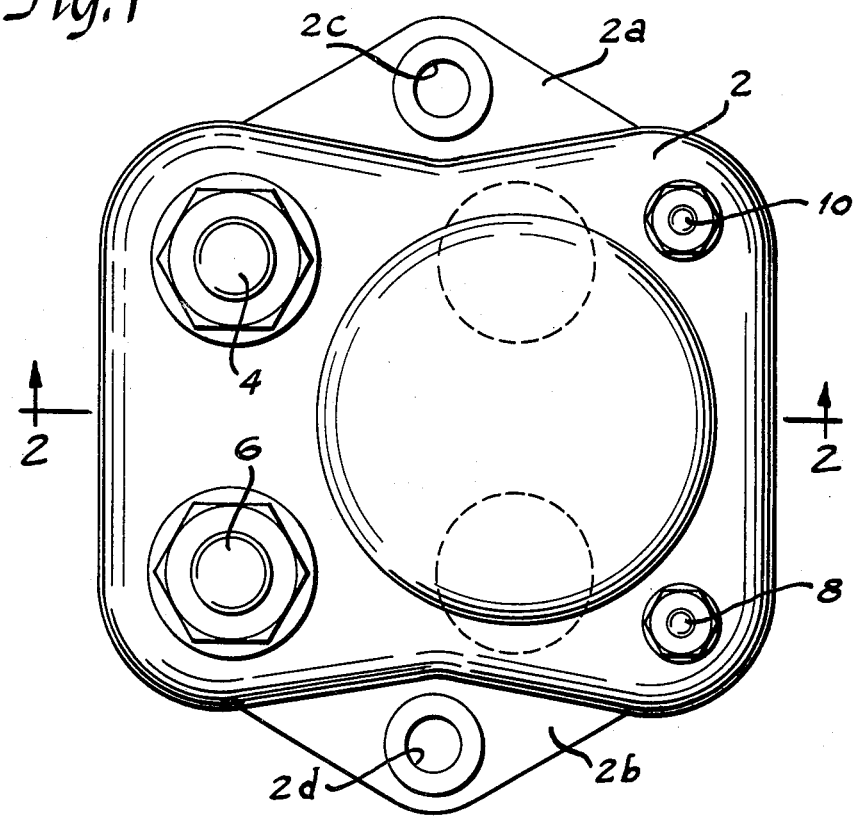
FIG. 1 is an enlarged top view of a hermatically sealed power relay to which the invention is applied.
Figure 2:
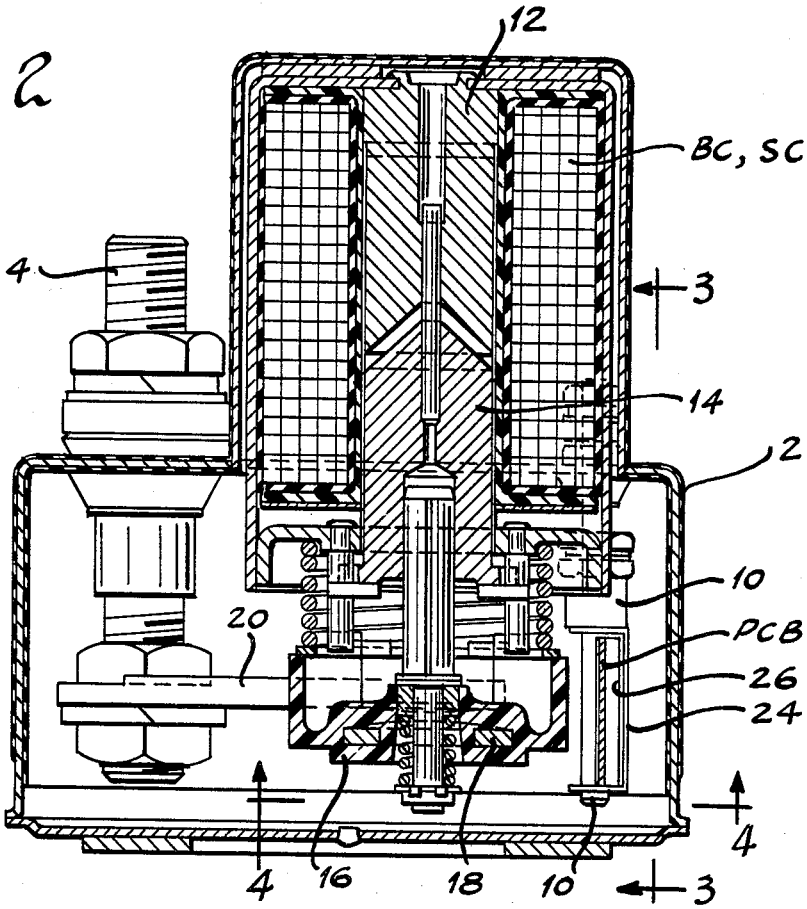
FIG. 2 is a cross-sectional view taken substantially along line 2—2 of FIG. 1 showing the static, electronic printed circuit board mounted within the relay housing.

Referring to FIGS. 1 and 2, there is shown a hermetically sealed power relay of the type to which the invention preferably is applied. As shown therein, this power relay is provided with a glass-coated metal housing 2 having a pair of flanges **2*a* and 2*b* with holes 2*c* and 2*d* therethrough by which the relay is secured to a mounting panel or the like support. This relay is also provided with a pair of power terminals 4 and 6 extending in hermetic sealing relation out through the housing, these terminals being bridged by the relay contacts when the relay is energized to control application of power in an external circuit. This relay is further provided with a pair of control terminals 8 and 10 through which electric power is applied to control energization of the relay coils including boost coil BC and seal coil SC shown in FIG. 5**.

As shown in FIG. 2, the relay is provided with a magnetic device similar, although not identical, to that shown and described in more detail in J. E. Davies et al U.S. Pat. No. 2,951,133, dated Aug. 30, 1960. This magnetic device comprises a ferrous magnetic structure 12, but differs in the boost and seal coil combination BC, SC. An armature 14 of the plunger type is arranged to be attracted by the magnetic structure. To this armature is mounted an insulating contact carrier 16 that carries a movable bridging contact 18 shown in FIGS. 2 and 4 for bridging a pair of stationary contacts connected to terminals 4 and 6, one of these stationary contacts 20 being shown in FIG. 2.

Figure 3:
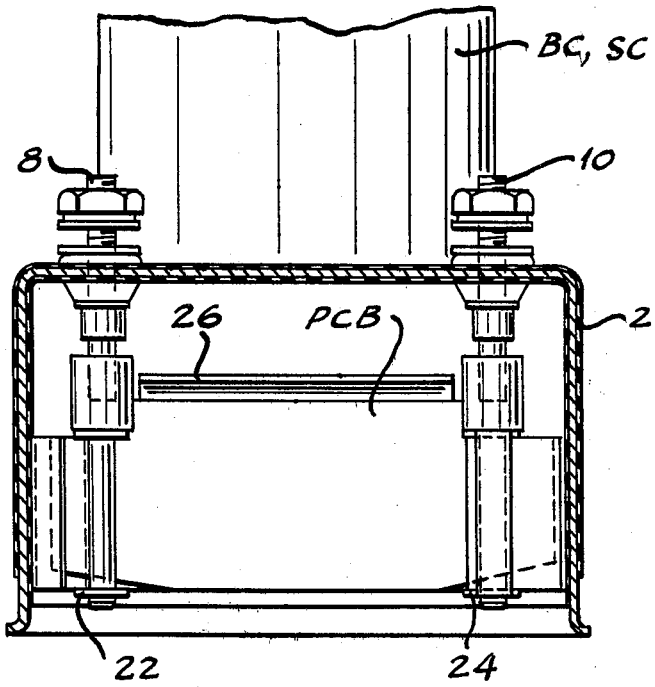
FIG. 3 is a cross-sectional view taken substantially along line 3—3 of FIG. 2 showing a side view of the static, electronic circuit board mounted between the terminals within the housing.
Figure 4:
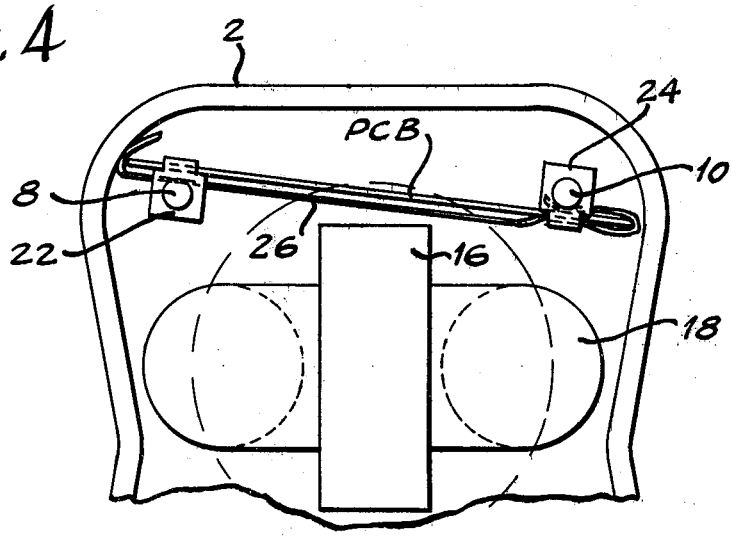
FIG. 4 is a partial cross-sectional view taken substantially along line 4—4 of FIG. 2 showing a bottom view of the static, electronic circuit board mounted within the housing.
Figure 5:
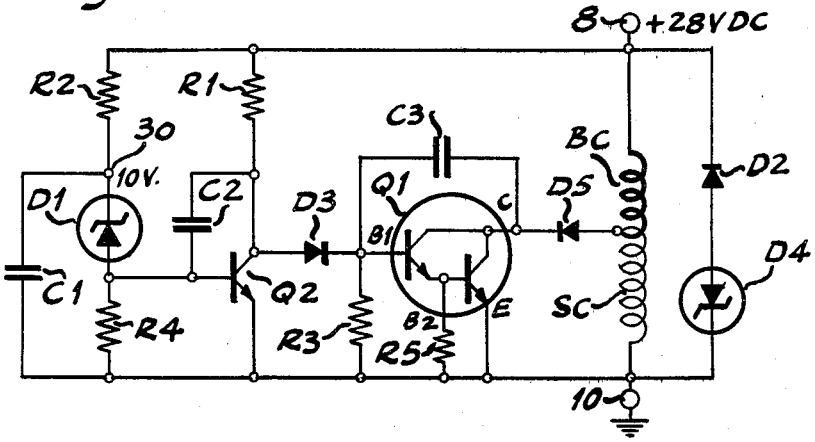
FIG. 5 is a schematic diagram of the static, electronic circuit mounted on the printed circuit board in FIGS. 2, 3 and 4.

Printed circuit board PCB, which carries the circuit shown in FIG. 5, is mounted to terminals 8 and 10 within the housing as shown in FIGS. 2, 3 and 4. These terminals extend down into the lower right-hand portion of the housing in FIG. 2 as shown more clearly in FIG. 3 and the printed circuit board is mounted thereto. For this purpose, a pair of generally U-shaped clamps 22 and 24, each having holes in the arms thereof through which the terminal passes, are used to mount the printed circuit board to these terminals, there being an insulating plate or sheet 26 between the conductor side of the printed circuit board and the adjacent relay contact assembly as shown in FIG. 4 to cover the printed circuits and insulate them from any arcing products of the contacts. As shown in FIG. 4, this insulating plate and the printed circuit board are clamped at their left end by clamp 22 to terminal 8 so that the insulating plate is between the terminal and the printed circuit board. At their right end, the printed circuit board and insulating plate are clamped to terminal 10 so that the insulating plate is between the printed circuit board and the clamp. Both ends of this insulating plate are tucked around the ends of the board as shown in FIG. 4. For secure mounting, these clamps are soldered to the terminals.

The opposite ends of series-connected boost coil BC and seal coil SC and the common connection therebetween are connected to the two terminals 8 and 10 and to the printed circuit as shown in FIG. 5 so that upon connection of operating electrical power of 28 volts D.C. or the like across terminals 8 and 10, the circuit in FIG. 5 can be operated.

The static, electronic circuit shown in FIG. 5 is provided with means for energizing boost coil BC alone across the 28 volt D.C. supply or for energizing boost coil BC and seal coil SC in series across the 28 volt D.C. supply. This boost coil is a relatively low resistance high current coil capable of operating the relay at low voltages, that is, at voltages substantially below the normal 28 volt value of the supply. The seal coil is a winding more typical of a normal coil used in such relays for 28 volt D.C. applications, that is, a relatively higher resistance lower current coil capable of operating the relay at rated voltage of 28 volts D.C. and capable of maintaining the relay closed after it has been operated without excessive power dissipation, hence the name "seal" coil.

The aforementioned means for energizing the boost and seal coils comprises the 28 volt D.C. supply connected across terminals 8 and 10, boost coil BC and seal coil SC being in series across terminals 8 and 10 as shown in FIG. 5. This means also comprises a transistor Q1 circuit. The common tap between coils BC and SC is connected through a reverse current blocking diode D5 to collector C of a high gain Darlington transistor pair Q while emitter E of the latter is connected to ground terminal 10. Also, supply terminal 8 is connected through a current limiting resistor R1 and a diode D3 to base B1 of transistor Q1 whereas base B2 of the latter is connected through a base-to-emitter return resistor R5 to ground. A base-to-emitter return resistor R3 is connected from base B1 to ground. An electrical noise suppressing capacitor C3 is connected between base B1 and collector C of transistor Q1.

Transistor Q1 is provided with means for controlling its conduction. This means comprises a transistor Q2 having its collector-emitter circuit connected from the junction between resistor R1 and diode D3 to ground. The base of transistor Q2 is controlled by a voltage level sensing and timing circuit.

This voltage level sensing and timing circuit comprises a connection from the 28 volt D.C. supply through a resistor R2 and capacitor C1 to ground, with the junction between resistor R2 and capacitor C1 being connected through a zener diode D1 to the base of transistor Q2. A base-to-emitter return resistor R4 is connected from the base of transistor Q2 to ground. An electrical noise suppressing capacitor C2 is connected between the base and collector of transistor Q2.

A transient voltage suppression circuit or "clamp" network that prevents excessively high reverse voltage transients from being induced by the relay coil when the current is interrupted is connected across coils BC and SC. This circuit includes a zener diode D4 and a unidirectional diode D2 connected in series in that order between ground terminal 10 and positive voltage supply terminal 8.

The circuit in FIG. 5 functions to maintain the power relay closed if its coil supply voltage should drop from 28 volts D.C. as low as 6 to 8 volts D.C. In addition, this circuit functions on application of coil voltage thereon to energize pull-in coil or boost coil BC for a timed interval to help close the relay contacts whereafter both coils BC and SC are energized in series since the maintaining current need not be as high as the pull-in current.

Upon application of supply voltage to the circuit shown in FIG. 5, current flows through resistor R2 to charge capacitor C1. Resistor R2 and capacitor C1 form an RC timing circuit to keep the voltage at junction 30 below the zener voltage of diode D1 for a time interval. The zener voltage of diode D1 may be 10 volts, for example. During this time interval, transistor Q2 remains off. Consequently, current will flow through resistor R1 and diode D3 into base B1 of Darlington transistor pair Q1 to turn it on. This causes energization of boost coil BC by current flow therethrough and through diode D5 and transistor pair Q1 to ground. This is a high gain Darlington transistor whereby a relatively high boost coil current flows producing a strong magnetic field. As a result, the relay armature pulls in to close the power contacts.

At the end of the aforementioned time interval, capacitor C1 has charged to a voltage high enough at junction 30 to cause zener diode D1 to conduct. Current then flows therethrough into the base of transistor Q2 to turn the latter on. Transistor Q2 grounds base B1 of Darlington transistor Q1 to turn the latter off. As a result, current now flows through coils BC and SC in series to maintain the relay closed at low current. This seal coil SC is a high resistance coil which is now the main source of magnetic field but at low power which is enough to maintain the relay closed.

Darlington transistor pair Q1 is essentially a power switch for the dual coil action. This Darlington transistor is preferably a U2T101 type in a compact TO-5 package that is small enough to be mounted on the printed circuit board within the relay housing but can handle the boost coil current and can be turned on and off with respect to the D.C. supply by transistor Q2.

To summarize, boost coil switching transistor Q1 is controlled by a voltage sensing time delay circuit wherein the applied voltage is sensed by resistor R2 and zener diode D1 and is fed to the base of control transistor Q2. When the applied voltage is high enough to forward bias the zener diode and base-to-emitter junction of transistor Q2, current will flow to the base limited only by resistor R2. Under these conditions, transistor Q2 is turned on and its collector is held low. Thus, switching transistor Q1 is turned off as its base current source is bypassed to ground. The boost and seal coils are now energized in series and a normal seal condition exists.

If the applied voltage is now reduced for some reason below the level, such as 12.5 volts, for example, where the voltage sensing network is forward biased, base current to transistor Q ceases and it is switched off because zener diode D1 stops conducting. This allows the base of transistor Q1 to be turned on by current through resistor R1 and diode D3. The boost coil is now energized to maintain the relay under reduced supply conditions so that there will be no intermittent opening and chatter of the relay contacts. If there is a drop in applied voltage to a level where the boost coil should be energized through transistor Q1, the RC delay action of resistor R2 and capacitor C1 does not significantly effect the response of the voltage sensing network. This is due to the fact that capacitor C1 does not charge up to a voltage above the threshold level of diode D1 and the base-to-emitter junction of transistor Q2 (capacitor C1 charges only up to such threshold level). Therefore, only a slight discharge of capacitor C1 during a drop in supply voltage below such threshold level causes the current through diode D1 to cease, thus initiating energization of the boost coil.

This circuit shown in FIG. 5 inherently provides a variably longer boost period upon relay energization if the supply voltage should be variably lower than its normal 28 volts D.C. value. For this purpose, it will be apparent that the aforementioned time delay, or boost pulse duration, is determined by the values of resistor R2 and capacitor C1 and the magnitude of voltage applied to the circuit. Thus, if a lower supply voltage such as 15 volts D.C., for example, is applied to the circuit, capacitor C1 will take longer to charge to the zener voltage of diode D1. As a result, the boost coil will be energized for a correspondingly longer period to give greater assistance to relay closure in proportion to what is needed under reduced supply voltage conditions. This action is desirable since at lower applied voltages the pull-in boost action may have to be longer to assure proper seal (or closure) of the relay than at full 28 volts D.C.

While the apparatus hereinbefore described is effectively adapted to fulfill the objects stated, it is to be understood that the invention is not intended to be confined to the particular preferred embodiment of integral relay low voltage retention means disclosed, inasmuch as it is susceptible of various modifications without departing from the scope of the appended claims.

We claim:

1. A D.C. actuatable electromagnetic device comprising:

a D.C. supply voltage source;

a low resistance boost coil and a higher resistance operating coil for said device connected for energization directly across said source;

solid state switching means for by-passing said operating coil and connecting said boost coil across said source and being effective when turned on for causing energization of said boost coil at high current across said source to provide a strong magnetic field for actuation of said electromagnetic device and being alternatively effective when turned off for reestablishing energization of said operating coil in series with said boost coil at lower current directly across said source to maintain said electromagnetic device actuated at normal supply voltage value;

and means for controlling said solid state switching means comprising:

control means responsive to drop in said supply voltage below a predetermined value for quickly turning said solid state switching means on thereby to energize said boost coil at high current across said source to prevent intermittent de-activation or chattering of said electromagnetic device.

2. The D.C. actuatable electromagnetic device claimed in claim 1, wherein:

said solid state switching means comprises a Darlington transistor pair capable of being turned on or off by said control means.

3. The D.C. actuatable electromagnetic device claimed in claim 2, wherein:

said solid state switching means also comprises bias means connected to said source for normally turning said Darlington transistor pair on;

and said control means comprises a control transistor circuit for shunting said bias means to turn said Darlington transistor pair off.

4. The D.C. actuatable electromagnetic device claimed in claim 3, wherein:

said control means also comprises a voltage level detector operable at normal supply voltage level to turn said control transistor circuit on and being responsive to said drop in said supply voltage below said predetermined value quickly to turn said control transistor circuit off thereby to render said bias means operable to turn said Darlington transistor pair on.

5. The D.C. actuatable electromagnetic device claimed in claim 4, wherein:

said control means also comprises a timer for delaying the rise of said supply voltage on said voltage level detector on initial application of said supply voltage thereto thereby to cause energization of said boost coil at said high current for a time interval to effect actuation of said electromagnetic device.

6. The D.C. actuatable electromagnetic device claimed in claim 5, wherein:

said solid state switching means and said control means are small enough to be mounted within the housing of a standard relay.

7. The D.C. actuatable electromagnetic device claimed in claim 5, wherein:

said control means further comprises means for preventing said timer from significantly delaying the response of said voltage level detector to turn said control transistor circuit off responsive to said drop in said supply voltage below said predetermined value comprising direct connection of said voltage level detector to the base of said control transistor.

8. The D.C. actuatable electromagnetic device claimed in claim 7, wherein:

said timer comprises an RC timer including a resistor and a capacitor whereby said capacitor is charged through said resistor from said D.C. source to delay the rise of voltage on said voltage level detector;

said voltage level detector comprises a zener diode;

and said delay preventing means comprises a discharge circuit for said capacitor through said zener diode directly to the base of said control transistor for quick discharge of said capacitor below the threshold level of said zener diode and transistor.

9. A D.C. power relay comprising:

a relay housing;

relay coil means energizable from said source and comprising a low resistance boost coil and a higher resistance operating coil in said housing;

relay contacts and a magnetic structure activated by said coil means for closing said contacts in said housing;

terminals for said contacts extending from within said housing to the outside thereof for connection to an external circuit to be controlled;

a D.C. supply voltage source;

terminals for said coils extending from within said housing to the outside thereof for direct connection to said D.C. supply voltage source;

and a control circuit for said coils small enough to be mounted on said coil terminals within said housing and comprising:

means connecting said coils in series directly across said coil terminals;

transistor switching means including biasing means therefor supplied from said source for energizing said boost coil in series therewith across said source with high current or for causing energization of both said boost coil and said operating coil in series directly across said source with lower current;

and low voltage retentive control means responsive to drop in the supply voltage below a predetermined value for quickly controlling said biasing means thereby to cause energization of said boost coil with high current without delay and prevent said relay contacts from intermittent opening.

10. The D.C. power relay claimed in claim 9, wherein:

said low voltage retentive control means comprises time delay means and voltage level sensing means controlled thereby for controlling said biasing means thereby to apply a timed high current pulse into said boost coil upon initial energization of said relay to help relay closure followed by application of lower current into both said coils for maintaining said relay closed.

11. The D.C. power relay claimed in claim 10, wherein:

said time delay means comprises means rendering the length of its time delay an inverse function of the drop in supply voltage down to a predetermined limit.

12. The D.C. power relay claimed in claim 10, wherein:

said voltage level sensing means comprises a zener diode and a transistor controlled directly thereby for shunting said biasing means;

said time delay means comprises a resistor and a capacitor charged from said D.C. voltage source through said resistor to delay the rise of voltage on said zener diode;

and said capacitor having a discharge path through said zener diode directly to the base of said transistor to effect quick discharge of said capacitor below the threshold voltage level thereof in response to said drop in said supply voltage below said predetermined value.

* * * * *